US007303006B2

(12) United States Patent
Stone

(10) Patent No.: US 7,303,006 B2
(45) Date of Patent: Dec. 4, 2007

(54) METHOD FOR IMPROVED VERTICAL SWEEP OF OIL RESERVOIRS

(76) Inventor: Herbert L. Stone, P.O. Box 22781, Houston, TX (US) 77227-2781

( * ) Notice: Subject to any disclaimer, the term of this patent is extended or adjusted under 35 U.S.C. 154(b) by 243 days.

(21) Appl. No.: 10/547,665

(22) PCT Filed: May 10, 2004

(86) PCT No.: PCT/US2004/014519

§ 371 (c)(1),
(2), (4) Date: Sep. 6, 2005

(87) PCT Pub. No.: WO2004/101945

PCT Pub. Date: Nov. 25, 2004

(65) Prior Publication Data

US 2006/0180306 A1 Aug. 17, 2006

Related U.S. Application Data

(60) Provisional application No. 60/469,700, filed on May 12, 2003.

(51) Int. Cl.
*E21B 43/18* (2006.01)
*E21B 43/20* (2006.01)
*E21B 47/10* (2006.01)
*E21B 49/08* (2006.01)

(52) U.S. Cl. ..... 166/245; 166/50; 166/252.1; 166/252.6; 166/264; 166/268; 166/269; 166/401; 166/402

(58) Field of Classification Search ..... 166/252.6, 166/269, 50, 245, 252.1, 250.12, 264, 268, 166/401, 402; 436/27; 703/10

See application file for complete search history.

(56) References Cited

U.S. PATENT DOCUMENTS

| | | | | | |
|---|---|---|---|---|---|
| 3,565,175 | A * | 2/1971 | Wilson | 166/269 |
| 3,882,940 | A * | 5/1975 | Carlin | 166/402 |
| 4,427,067 | A * | 1/1984 | Stone | 166/272.2 |
| 4,715,444 | A * | 12/1987 | MacAllister et al. | 166/269 |
| 4,846,276 | A * | 7/1989 | Haines | 166/401 |
| 4,856,589 | A * | 8/1989 | Kuhlman et al. | 166/403 |
| 5,244,041 | A * | 9/1993 | Renard et al. | 166/268 |
| 5,634,520 | A * | 6/1997 | Stevens et al. | 166/402 |
| 6,119,776 | A * | 9/2000 | Graham et al. | 166/245 |
| 6,325,147 | B1 * | 12/2001 | Doerler et al. | 166/252.1 |
| 7,006,959 | B1 * | 2/2006 | Huh et al. | 703/10 |
| 2006/0224369 | A1 * | 10/2006 | Yang et al. | 703/10 |

* cited by examiner

*Primary Examiner*—George Suchfield

(57) ABSTRACT

In a WAG flood oil is displaced from a subterranean formation by injecting water alternately with gas into a single injection completion per pattern. The ratio of water to gas injected is the WAG ratio. In this invention, two separate injection completions are used in each pattern, with one placed directly above the other. A very low WAG ratio is used for injection into the bottom extremity of the formation. A very high WAG ratio is injected into the upper interval, at as high a rate as can safely be used without fracturing the formation. In the preferred embodiment, two horizontal well bores serve as the two completion intervals. Proper design of this method gives a vertical sweep efficiency of the gas that is several-fold greater than the best of previous WAG flood designs, especially in thin formations.

20 Claims, 10 Drawing Sheets

HORIZONTAL WELL APPLICATION IN A PATTERN ELEMENT

HORIZONTAL WELL APPLICATION IN A PATTERN ELEMENT

VERTICAL WELL APPLICATION
IN A PATTERN ELEMENT

LOCATION OF MIXED FLOW ZONE FOR CONVENTIONAL WAG, 29 FOOT FORMATION

LOCATION OF MIXED FLOW ZONE, ENHANCED DESIGN, 29 FOOT THICK FORMATION

LOCATION OF MIXED FLOW ZONE FOR CONVENTIONAL WAG, 290 FOOT FORMATION

LOCATION OF SECOND FLUID FINGER WITH 100% WATER INJECTION INTO TOP

LOCATION OF MIXED FLOW ZONE FOR BALANCED INJECTION

LOCATION OF MIXED FLOW ZONE FOR TOO HIGH A DRAIN OFF RATE

LOCATION OF MIXED FLOW ZONE WITH EXCESS SECOND FLUID INJECTION

WAG RATIO SELECTION

Permeabilities Reversed from FIG. 9 Formation

HOR ZONTAL WELLS, 480 ACRE SPACING,
MAXIMUM INJECTION RATE

Location of Mixed Flow Zone, Horizontal Wells,
1,920 Acre Spacing, Maximum Injection Rate

TWO-WAY FLOW, HORIZONTAL WELLS,
1,920 ACRES, MAXIMUM INJECTION RATE

SWEEP VERSUS PATTERN AREA, VERTICAL WELLS, MAXIMUM RATE

SWEEP VERSUS PATTERN AREA, MAXIMUM INJECTION RATE

METHOD FOR IMPROVED VERTICAL SWEEP OF OIL RESERVOIRS

This application claims the benefit of U.S. Provisional Patent Application No. 60/469,700, filed May 12, 2003.

BACKGROUND OF THE INVENTION

1. Field of the Invention

This invention pertains to recovery of crude oil from subterranean reservoirs by injecting both water and a second less dense fluid to displace the oil, preferably through horizontal wells. The invention is based on the proper selection of spacing and relative location of injection and production wells, and proper selection of injection rates and location of injection completion intervals for both water and the second fluid.

2. Description of the Related Art

Although gas efficiently displaces oil in a vertical downward displacement that is aided by gravity, gas displacement of oil by predominantly horizontal flow is inefficient because of the low viscosity of the gas relative to the oil. The gas fingers through the oil, giving poor conformance and resulting in a low recovery of the oil. Injecting water along with the gas was proposed to control this fingering and poor conformance. The water decreases the mobility of the gas by lowering the relative permeability of the formation to the gas. Field tests showed it was most feasible to inject the water alternately with the gas. This process is known as WAG flooding. The ratio of the volume of water injected to the volume of gas injected is the WAG ratio. Injection of any second fluid, not just gas, alternately with water is now termed WAG flooding. Much of the literature on WAG flooding has centered on the use of water and miscible or nearly miscible fluids that reduce the residual oil after flooding to a value near zero. However, immiscible gases may also provide a substantial beneficial lowering of the residual oil. Thus if miscible gas is not available, or is too expensive to use, then immiscible gases should be considered the WAG flooding.

The literature on this lowering of the residual oil by the presence of an immiscible gas is briefly reviewed here. The reduction of resident oil below that of a water flood is expressed here and in the literature as a fraction of the gas trapped at the end of the flood. In evaluated these data, it is important to remember that although different authors may use the same term like "weakly water-wet" to describe their samples, it is unlikely that their sample wettability conditions are identical. Such terms are not precisely defined nor controlled in experiments; these terms are qualitative, rather than quantitative.

Skauge (1994) (Skauge, A., 1996, "Influence of Wettability on Trapped Nonwetting Phase Saturation in Three-phase Flow," Proceedings 4th International Symposium on Wettability and Its' Effect on Oil Recovery, Montpellier, France, Sept.) reports a fraction ranging from 0.5 to 1.0 for water wet systems and 1 for weakly water wet systems. For the systems with a fraction of 1.0, immiscible gas displacement is essentially as effective as miscible gas, and, being cheaper, will be more attractive economically. Other investigators did not find fractions as high as Skauge, McAllister et al., 1993, reported fractions of 0.75, 0.25 and 0.4 for water wet, mixed-wet and oil-wet conditions, respectively. Their core samples were Baker dolomite. For water-wet systems, Holmgren and Morse, 1951, and Kyte et al., 1956, suggest that this fraction is roughly 0.5. Kralik et al., 1996, gave previously unpublished data from the 1950s of 0.59±0.09, 0.51±0.08 and 0.45±0.08 for water-wet, weakly water-wet and intermediate-wet samples. Kyte et al. also reported a fraction of zero for an oil wet system, as did Kralik et al. When this fraction is zero, immiscible WAG does not result in additional recovery above water flood and so should not be used.

Salathiel in 1973 (Salathiel, R. A. 1973 "Oil Recovery by Surface Film Drainage in Mixed-Wettability Rocks," JPT Oct. pp. 1216-1224.) postulated a likely way that reservoirs could become mixed-wet during oil accumulation over geologic time and simulated it in laboratory experiments. He also reviewed literature data, much of which supports the view that most reservoirs would be expected to be "mixed-wet", "weakly water-wet" or "intermediate-wet", using the various terms applied by the above authors.

Although there is appreciable variation in the above fractional reduction data, the preponderance shows fractions in the 0.5-1.0 range, except for the rarely encountered strongly oil-wet systems. This range is high enough to mandate investigation of the effectiveness of immiscible gases for specific field and fluid systems, rather than assuming that miscible WAG flooding is always most economic.

Gas phase tracers, though not essential, can be very helpful in monitoring and controlling WAG floods. Yang, et al., 2000, ("Tracer Technology for Water-Alternating-Gas Miscible Flooding in Pubei Oil Field") report a series of perfluorocarbons that they found useful for this purpose. Yang and Zhang, 1999, present methods for detecting and analyzing for these perfluorocarbons.

Oil recovery by WAG flooding has been limited by gravity segregation of the gas and water. Gravity segregation is not limited to WAG flooding, but occurs in all flooding processes. Gravity segregation in a typical water flood is described in U.S. Pat. No. 3,565,175 issued to Wilson on Feb. 23, 1971. In a WAG flood, gravity causes the gas to rise to the top of the reservoir and water to migrate to the bottom. After segregation is complete, a miscible flood occurs in a thin layer at the top of the reservoir. The remainder of the reservoir is only water flooded. Various methods have been proposed to control or reduce gravity segregation in WAG floods and various other water and miscible flooding methods. For example, Wilson (3,565,175 February 1971 Wilson 166/269) describes a method for reducing gravity segregation of an aqueous flooding fluid in a reservoir containing fluids of a lower density than the aqueous flooding fluid. That method calls for adjusting the viscosity of the aqueous flooding fluid injected into progressively lower levels of the reservoir. This adjustment is said to decrease the mobility of the fluid sufficiently to offset the additional pressure exerted at the lower levels by the higher density aqueous flooding fluid. The pressures are more nearly equal at all levels, tending to improve conformance. Another example is U.S. Pat. No. 3,661,208 to Scott et al, issued May 9, 1972. That patent describes a method for controlling gravity segregation in a miscible gas flood process by maintaining the reservoir at such a pressure that the miscible fluid has a density essentially the same as that of the reservoir oil. Yet another example is U.S. Pat. No. 4,427,067 to Stone, issued Jan. 24, 1984. That patent describes a WAG flood design using sufficiently close well spacing and high enough injection rates so inhibit, but not to eliminate, gravity segregation, Huang et al., in U.S. Pat. No. 5,320,170 issued Jun. 14, 1994, propose using a combination of horizontal and vertical wells to counteract gravity, and claim a modest improvement in recovery by doing so. Stevens et al. in U.S. Pat. No. 5,634,520, issued Jun. 3, 1997, claimed the use of short gas injection cycles to increase recovery, by achieving a more uniform vertical distribution of the gas injected. McGuire et al. in 1999 noted that the WAG flood at Prudhoe Bay is strongly gravity dominated, and the MI (i.e.—second fluid) sweeps oil near the injection well, but gravity segregation causes it to leave large areas of the reservoir unaffected. They proposed the use of both vertical & horizontal wells to inject the second fluid low in the formation in order to make gravity segregation take place over a greater distance, and therefore to require more time to occur. This increased time results in greater second fluid penetration into low levels of the formation, and hence greater oil recovery. Their test of a vertical well for this purpose did not give very favorable results. Drilling horizontal wells near the bottom of the formation for alternate water and MI injection worded better. They concluded that in a gravity dominated reservoir like Prudhoe Bay, this approach appears to be economically competitive with WAG flooding as proposed by Stone, see above. Both Edwards et al. in 2000 and Redman in 2002 confirmed the beneficial effect of such horizontal injection wells.

However, gravity segregation remains a problem in WAG flooding. The various methods proposed to control or reduce gravity segregation are often not economically feasible. They are expensive processes in themselves and/or they do not result in enough oil recovery to make the profitable. Other such methods are successful only in certain types of reservoirs or under certain reservoir conditions. Usually such methods, while appropriate for water floods or miscible slug drives, are not useful for improving the vertical conformance of a WAG flood. Methods are needed that will yield higher vertical conformance in a WAG flood.

SUMMARY OF INVENTION

In a WAG flood oil is displaced from a subterranean formation by injecting water alternately with gas through a single injection completion per pattern. The ratio of water to gas injected is the WAG ratio. Recovery using the prior art is severely limited by gravity segregation of the water and the second fluid. This invention increases recovery several-fold above that of the prior art, by using two distinct completion intervals per pattern and by using horizontal injection wells, to slow and control this segregation.

Most of the second fluid is injected into an injection zone located near the bottom of the reservoir, using a low WAG ratio there. This maximizes the distance this fluid has to traverse before it is segregated.

A high WAG ratio is used for injection into the remaining, upper part, of the formation. The resulting low second fluid saturation and mobility there allows control of the segregation at a low rate.

Horizontal wells are used to allow the use of a higher water injection rate than can be used with vertical wells. This higher rate carries the second fluid further into the reservoir in the time required for segregation to take place, thereby increasing vertical sweep and recovery. The injection rate through a well is limited by the pressure at which the reservoir will fracture. Therefore, for a vertical injection well, the maximum injection rate that will not fracture the reservoir is proportional to the thickness of the formation. For a horizontal well, the maximum rate is proportional to the length of one side of the pattern. For an 80 acre pattern and a 290 foot thick formation, the horizontal well injection rate will be about 6.44-fold greater than the vertical one. If the thickness is only 29 feet, then this ratio increases to 64.4, which indicates that horizontal-well WAG is applicable to thinner reservoirs than vertical well WAG.

The second fluid can range from one that is first-contact miscible with the in-place oil, to natural gas, or even non-hydrocarbon fluids such as carbon dioxide, nitrogen or the gas. The literature indicates that all of these fluids have the potential of increasing recovery above that of water flood, provided the reservoir matrix has suitable wettability characteristics.

DETAILED DESCRIPTION OF THE INVENTION

In a preferred embodiment, only second fluid is injected into the bottom injection interval, and only water into the top. At selected times and for selected time periods, the water injection is stopped. During these periods, gravity will cause the continuing second fluid injection to flow into the upper injection interval. When water injection is resumed, it will move this second fluid into the formation and mix with it. The net effect is a high WAG ratio injection into the upper part of the reservoir that can be controlled by the frequency and length of the interruptions of the water injection. The frequency of these water stoppages should be high, and the length short. The length should be no greater than the time it takes the second fluid injected at the bottom to reach the top of the reservoir. One way of accomplishing this shortness is to have a detector for the second fluid located near the top of the reservoir directly, above the second fluid injector, perhaps placed in or just outside the water injector. Preferably, this detector would automatically cause the water injection to resume.

Industrial Applicability

Figure 1:
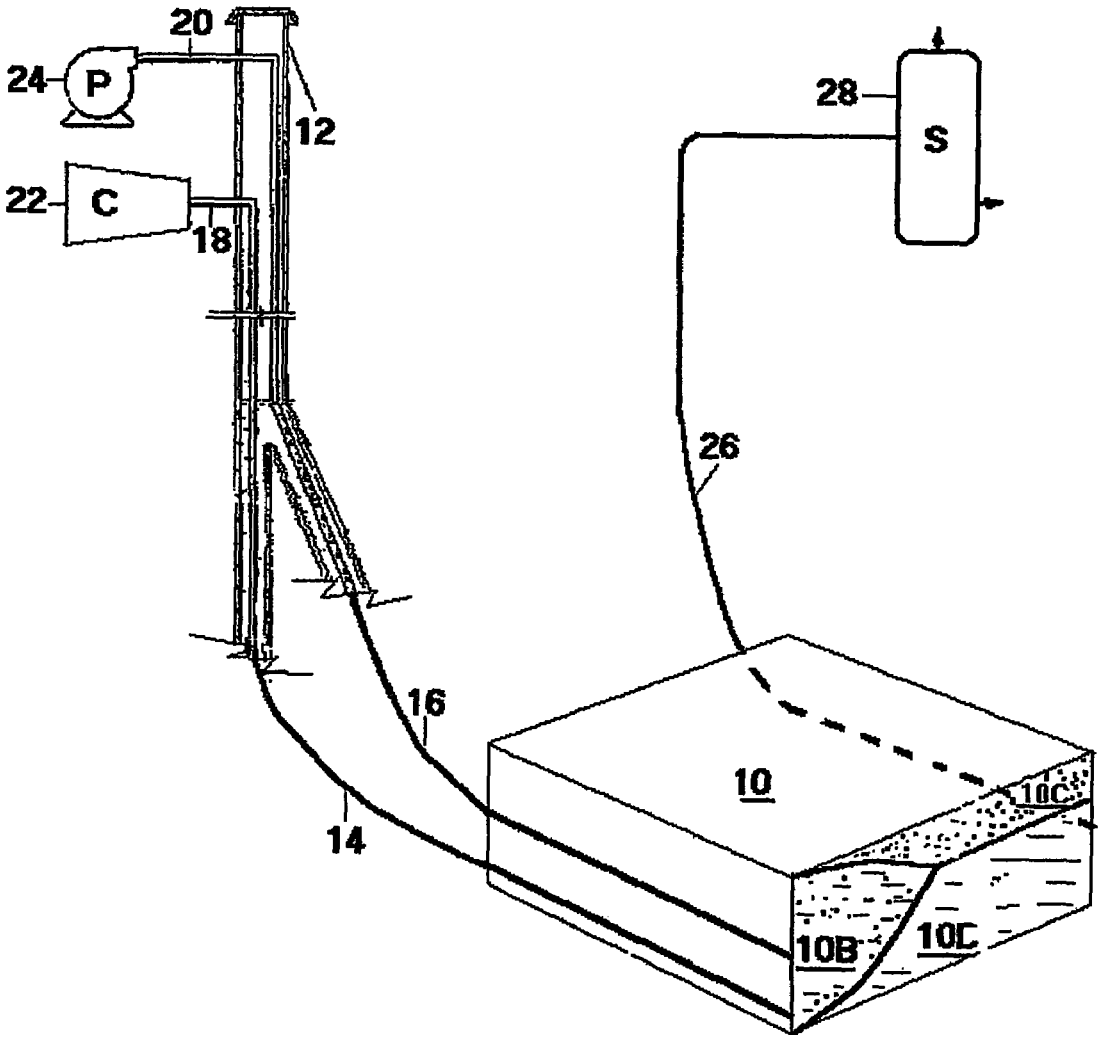
FIG. 1 illustrates a preferred embodiment of this invention, using horizontal wells.

Application of this invention using horizontal wells generally yields several-fold higher oil recovery than does using vertical wells. Two such injection well bores are required for each pattern and should be completed along the full length of one edge of the pattern. This location will convert a 5-spot pattern into a line drive one. These well bores may be provided by two sidetracks from a single well, or completely different wells may be used. In either event, they should be drilled parallel to any existing unidirectional fracture system, to achieve the best horizontal sweep. This alignment with the fracture system and the line drive pattern gives horizontal wells a generally improved areal conformance compared to vertical wells, to complement their higher vertical sweep. In FIG. 1 these two well bores 14 and 16 penetrate Pattern Element 10 horizontally and are parallel to each other. Well bore 14 is near the bottom of the formation, and injection into it is predominantly second fluid. If there is a water table present well bore 14 should be well below the water oil contact. Well bore 16 is placed directly above well bore 14, and injection into it is predominantly water. It should be equipped with detectors for the second fluid. Injection into well bore 16 will be just below the maximum rate that the formation will allow, with the well bore internal pressure being near the fracturing pressure. Therefore, its completion should be such that it offers little resistance to the flow of the injected water. However, injection into well bore 14 will be far below its capacity because of the low viscosity of the second fluid. For that reason, injection will be more uniform, as is desired, along its length if it has a completion that has a high flow resistance compared to that of the formation. One way of accomplishing this is to have very sparse and small perforations uniformly distributed along the entire pattern width. The depth of well bores 14 and 16 may be selected for each pattern. They are sidetracked from a single well 12 that is provided with two flow paths for injecting fluid through it. One of these, 18, continues into sidetracked well bore 14. The other, 20, continues into sidetracked well bore 16. In the preferred embodiment illustrated here, path 18 will transport only the second fluid and path 20, only water. In this embodiment, the small amount of second fluid needed in the upper part of the formation may be placed there by ceasing water injection into the upper well bore for a short time period, while continuing second fluid injection into the lower one. In the absence of water injection, gravity will quickly distribute the second fluid being injected at the bottom of the reservoir vertically over the entire thickness of the formation. The time that the water injection is ceased should be short to avoid accumulating excess second fluid at the top of the reservoir, where it will be largely wasted. To achieve the desired WAG ratio in the upper part of the reservoir, the frequency of these water stoppages likely will be high. The length should be no greater than the time it takes the second fluid injected at the bottom to reach the top of the reservoir. One way of accomplishing this shortness is to have a detector for the second fluid located near the top of the reservoir directly above the second fluid injector, perhaps placed in or just outside the water injector. Preferably, this detector would automatically cause the water injection to resume. Compressor 22 may be provided for supplying the second fluid under pressure to flow path 18, and pump 24 may be provided for supplying water to flow path 20. A horizontal production well, 26, is located at the far extremity of the pattern element, parallel to the injection wells, and toward the bottom of the formation. Suitable produced fluid handlers may be provided at 28. In a less preferred embodiment, because it is operationally more complex and difficult, the small portion of the second fluid needed in the water flow zone may be injected alternately with water, directly into the water injection well. In a second less preferred embodiment, a small amount of water may be injected alternately with the second fluid through the lower well.

Figure 2:
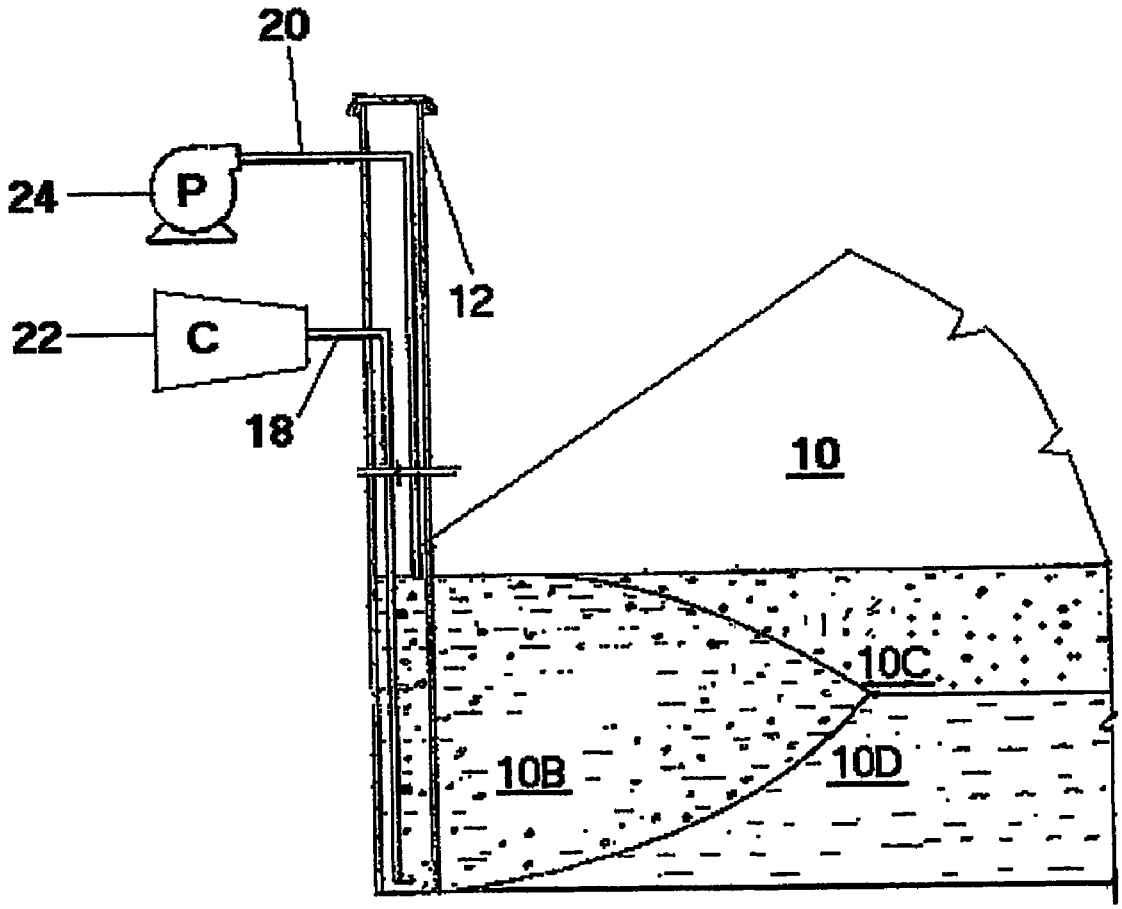
FIG. 2 illustrates a second embodiment of this invention, using vertical wells.

Although horizontal wells generally result in much greater vertical sweep, vertical wells may also be used in this invention. Developed fields may have existing vertical wells, or there may be other reasons for using them. It is generally most economical for the water and second fluid injections to be made from the same vertical well bore as illustrated on FIG. 2. Alternatively, separate wells may be used. Referring to FIG. 2, pattern element 10 is penetrated vertically by well 12. Well 12 is provided with two flow paths for transporting fluid down the well, which are indicated as 20 and 18. Path 18 transports the second fluid to a thin layer at the bottom of pattern element 10. Path 20 provides water injection into pattern element 10 in the remaining thickness of the reservoir. The length of these completion intervals may be selected in each well. The path 20 completion interval should be packed off from the path 18 one to lower mixing of the two fluids. The small amount of second fluid injected into the upper completion interval may be placed there by either of the two methods described above for horizontal wells. Back flow through the annulus should be controlled by a check-valve located just above the top of the oil-bearing formation, to prevent the second fluid entering the annulus in the top part of the well. Water may be injected through tubing, as illustrated in FIG. 2, or through the well annulus. Compressor 22 may be provided for supplying the second fluid under pressure to flow path 18 and pump 24 may be provided for supplying water to flow path 20.

The present invention is premised on the fact that gravity segregation in a WAG flood requires some time to occur. The shaded cross section on FIG. 1 illustrates the quasi-steady state fluid distribution around a well when gas and water are injected as described above for a long period of time. In the region immediately adjacent to the injection well, the injected water and the second, lower density, fluid flow together in a mixed flow zone, as indicated by zone 10B in FIG. 1. As gravity causes the second fluid to migrate toward the top of the reservoir and water toward the bottom, two additional zones develop, as indicated by zones 10C and 10D in FIG. 1. Only the second fluid is mobile in zone 10C and only water in zone 10D, but both water and the second fluid are mobile in the mixed flow zone 10B. As the water and the second fluid progress through the reservoir over time, zone 10B becomes thinner while the zones 10C and 10D become thicker. When the top and bottom zones meet, gravity segregation is complete, resulting in essentially only a water fluid oil recovery down stream from this point.

In both the mixed flow zone, 10B, and top zone, 10C, a second fluid saturation is present at the end of the flood, and in most reservoir systems this presence results in a substantially lower residual oil saturation than that left after a water flood. In the case of the second fluid being miscible with the in-place oil, the residual oil approaches zero. If the second fluid is immiscible with the oil, investigators report a wide range of residual oil abatement, some almost as high as for miscible fluids. The bottom zone 10D is not contacted by the second fluid and therefore has the water flood residual. The average recovery for the reservoir flooded may be estimated by calculating the total volume occupied by each zone. The average oil recovery for the reservoir equals the sum for all three zones of the product of the fractional volume of each zone times the recovery from that zone.

Currently, WAG flooding is practiced only on relatively thick reservoirs (ex.—100s of feet). The second fluid sweep at the end of an 80 acre pattern flood in a thin 29 foot thick reservoir will be used to illustrate why this is so. A reservoir simulator that is able to establish quasi-steady state zone boundaries if the capillary pressure is negligible was used in this and the other calculations described herein. The reservoir description data used in these simulations are given in Tables I, II & III. A summary of the results of the simulations is given in Table IV.

TABLE I

FLUID DATA

| | |
|---|---|
| Density difference, water and second fluid, #s/cu. Ft. | 35.0000 |
| Water viscosity, cp. | 0.3100 |
| Gas viscosity, cp. | 0.0425 |
| Oil viscosity, cp. | 0.7500 |
| TPV, WAG injection | 1.2000 |
| TPV, prior water flood | 1.5000 |

TABLE II

RESERVOIR DATA

| Layer | lower | upper |
|---|---|---|
| Thickness, % of total | 34.48 | 65.52 |
| Porosity, fraction | 0.21 | 0.21 |
| Horizontal permeability, md. | 600.00 | 225.00 |
| Vertical Permeability, md. | 240.00 | 56.25 |

TABLE III

RELATIVE PERMEABILITY AND CAPILLARY PRESSURE DATA

| $S_{sf}$ | $k_{r,\,sf}$ | $k_{r,\,w}$ | $P_{c,\,sf,\,w}$ #/in2 |
|---|---|---|---|
| 0 | 0 | 1 | |
| 0.02 | 0.00000000 | 0.91147740 | |

TABLE III-continued

RELATIVE PERMEABILITY AND CAPILLARY PRESSURE DATA

| $S_{sf}$ | $k_{r,\,sf}$ | $k_{r,\,w}$ | $P_{c,\,sf,\,w}$ #/in2 |
|---|---|---|---|
| 0.04 | 0.00000000 | 0.82879310 | |
| 0.06 | 0.00000000 | 0.75170060 | |
| 0.08 | 0.00000000 | 0.67995760 | |
| 0.10 | 0.00000000 | 0.61332620 | |
| 0.12 | 0.00000000 | 0.55157260 | |
| 0.14 | 0.00000000 | 0.49446770 | −46.1956 |
| 0.16 | 0.00000000 | 0.44178650 | −46.1956 |
| 0.18 | 0.0000000 | 0.39330870 | −3.98608 |
| 0.20 | 0.00000487 | 0.34881830 | −2.27247 |
| 0.22 | 0.00002852 | 0.30810410 | −1.60622 |
| 0.24 | 0.00010073 | 0.27095920 | −1.24121 |
| 0.26 | 0.00026885 | 0.23718170 | −1.00698 |
| 0.28 | 0.00060062 | 0.20657410 | −0.842106 |
| 0.30 | 0.00118622 | 0.17894380 | −0.718747 |
| 0.32 | 0.00214021 | 0.15410320 | −0.622346 |
| 0.34 | 0.00360330 | 0.13186940 | −0.544512 |
| 0.36 | 0.00574391 | 0.11206440 | −0.480046 |
| 0.38 | 0.00875971 | 0.09451554 | −0.425545 |
| 0.40 | 0.01287901 | 0.07905497 | −0.378680 |
| 0.42 | 0.01836210 | 0.06552021 | −0.337799 |
| 0.44 | 0.02550252 | 0.05375403 | −0.301697 |
| 0.46 | 0.03462828 | 0.04360456 | −0.269469 |
| 0.48 | 0.04610303 | 0.03492542 | −0.240420 |
| 0.50 | 0.06032716 | 0.02757582 | −0.214007 |
| 0.52 | 0.07773886 | 0.02142067 | −0.189796 |
| 0.54 | 0.09881522 | 0.01633071 | −0.167432 |
| 0.56 | 0.12407320 | 0.01218263 | −0.146620 |
| 0.58 | 0.15407060 | 0.00885925 | −0.127107 |
| 0.60 | 0.18940700 | 0.00624969 | −0.108668 |
| 0.62 | 0.2307247 | 0.00424952 | −0.091094 |
| 0.64 | 0.2787097 | 0.00276103 | −0.074174 |
| 0.66 | 0.3340925 | 0.00169341 | −0.057671 |
| 0.68 | 0.3976488 | 0.0009631 | −0.041259 |
| 0.70 | 0.4702007 | 0.00049407 | −0.024344 |
| 0.72 | 0.5526172 | 0.00021827 | −0.004681 |
| 0.74 | 0.6458152 | 7.6138E−05 | 0.2893063 |
| 0.76 | 0.7507600 | 1.7256E−05 | 0.6725563 |
| 0.78 | 0.8684667 | 1.3641E−06 | 1.5002860 |
| 0.80 | 1 | 0 | 5.3979030 |

TABLE IV

SUMMARY OF DATA FOR SIMULATIONS PRESENTED IN FIGURES

| Fig. No. | Total Inject. $ft.^3$/day | Thick-ness feet | Area acres | WAG Ratio avg. | WAG Ratio upper | Vert. Sweep % |
|---|---|---|---|---|---|---|
| 3 | 3488.6 | 29 | 80 | 5.76 | N/.A | 3.1 |
| 4 | 224,565.0 | 29 | 80 | 5.76 | 28.4 | 94.1 |
| 5 | 34,886.0 | 290 | 80 | 9.80 | N/.A | 9.7 |
| 6 | 34,886.0 | 290 | 80 | 9.80 | 165.7 | N/.A |
| 7 | 34,886.0 | 290 | 80 | 8.92 | 165.7 | 46.4 |
| 8 | 34,886.0 | 290 | 80 | 17.02 | 165.7 | 30.2 |
| 9 | 34,886.0 | 290 | 80 | 6.02 | 165.7 | 46.1 |
| 11 | 34,886.0 | 290 | 80 | 6.02 | 165.7 | 48.5 |
| 12 | 549,975.0 | 290 | 480 | 8.92 | 165.7 | 83.4 |
| 13 | 1,099,950.0 | 290 | 1,920 | 8.92 | 165.7 | 60.0 |
| 15 | 2,199,900.0 | 290 | 7,680 | 8.92 | 165.7 | 30.0 |

Figure 3:
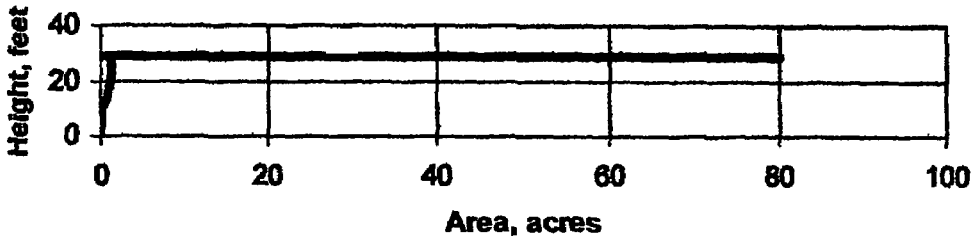
FIG. 3 shows the location of the mixed flow zone in which both water and second fluid are mobile for a conventional WAG flood (injection of water and second fluid alternately through the same completions), using vertical wells in a thin, 29 foot thick, formation.
Figure 4:
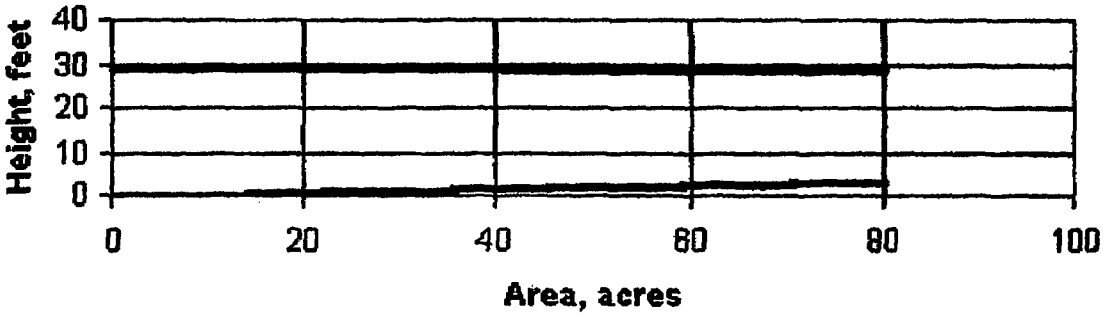
FIG. 4 shows the location of the mixed flow zone for this same thin reservoir using this invention.
Figure 5:
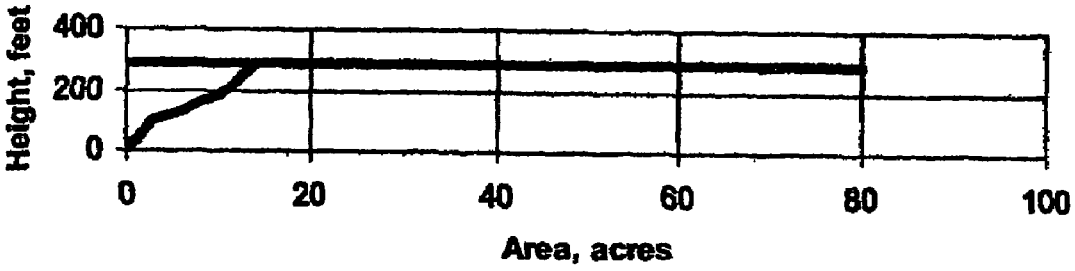
FIG. 5 shows the location of the mixed flow zone for conventional WAG flooding using vertical wells in a 10-fold thicker reservoir.

NOTE:
FIGS. 4, 6-9, 11-13, & 15 are for 100% second fluid injected into the lower interval. FIGS. 3 & 5 are conventional WAG, uniform top to bottom injection.

Neglecting capillary pressure exaggerates vertical sweep somewhat. Therefore, in applying this patent, commercial or proprietary reservoir simulators should be used, with the appropriate capillary pressure data provided as input data. Such a simulation also provides the transient behavior of the WAG flood that is needed in designing a field application. The simulator used must have the capability of accurately locating the said zone boundaries that lie at obliquely upward angles that vary both in space and with time, and therefore cannot be aligned with a fixed in space calculation grid. The simulator will need to be capable of keeping spurious mixing of water and the second fluid (so-called numerical dispersion) at acceptable levels, since such mixing may obscure the boundary locations. A very fine two-dimensional grid (e.g.—1,000 vertical blocks and 100 horizontal blocks) will go a long way toward achieving the desired accuracy, but the grid size must be refined until convergence of the solution is obtained, to establish its adequateness. Using area as the horizontal dimension variable in a two dimensional grid will augment the accuracy of the simulation.

Such a commercial or proprietary reservoir simulator is used to custom design WAG floods for this invention for specific reservoirs. The reservoir and fluid data are used in a series of simulations to select economically superior pattern sizes, well locations, WAG ratios, completion intervals, injection rates, etc. Because reservoir properties are only imprecisely known, said design may need to be modified during its application, by using data obtained from second fluid tracers, as described below.

The 29 foot thick formation simulated is comprised of two horizontal layers having different properties. The top layer is 19 feet thick, and has a horizontal permeability of 225 md. The bottom layer is 10 feet thick, and has a horizontal permeability of 600 md. The total injection rate, limited by the fracturing pressure, is 3,488.6 cu. ft/day. The data given in Tables I, II & III apply to this reservoir. The reservoir description given in these tables is used in all but one of the simulation presented hereafter. In that one, the vertical location of the two layers is interchanged.

FIG. 3 shows the location of the mixed flow zone existing in this 29 foot thick formation after quasi-steady state is reached. The total flow rate for this calculation is just below the maximum rate that the formation will allow without fracturing, because high rate in a WAG flood is beneficial to oil recovery. In this figure, height above the bottom of the formation is the ordinate, and the abscissa is cumulative horizontal area from the injection well. Horizontal area is the fundamental variable that controls gravity segregation, not distance or volume. Various regions of the reservoir are characterized by constant saturations in which the gravity drainage rate is constant. Thus, complete gravity segregation of the fluids entering that region require a fixed horizontal area to be completed, regardless of whether flow is radial, linear or variable within a pattern. Therefore, an areal plot is applicable to radial, linear, or pattern flow.

The top second fluid mobile zone is so thin that it is imperceptible on this figure, because of the low viscosity of that fluid. The mixed flow zone shown in FIG. 3 is less than 1% of the formation. The total vertical sweep, most of it from the override zone, is 3.1% Gravity drainage is complete within the first 1.35 acres of this 80 acre pattern. This result shows that current WAG methods are ineffective for such a thin reservoir.

This invention combines three enhancing features that increase effectiveness, even for a thin formation.

First, the distance into the formation required for complete gravity segregation to occur, and hence recovery, increases as the vertical distance over which the second fluid has to flow to reach the top of the formation increases. For the conventional (one injection zone) WAG flood just discussed, this distance is one half the reservoir thickness, because that is the average distance that the injected fluid must rise to reach the top. To increase this distance, the second fluid is injected near the bottom of the formation.

Second, said distance required for segregation is also an inverse function of the second fluid mobility in the mixed flow zone, which is its relative permeability divided by its viscosity. In conventional WAG flooding this mobility is large. To increase said distance, in this invention this mobility is controlled at a low value in the top part of the formation by injecting fluids at a high WAG ratio throughout this region.

Third, said distance also increases as the total injection rate into the pattern increases. Injection rate is limited by the pressure at which the reservoir will fracture, because fractures cause channeling of the injection fluids, leading to bypassing of otherwise producible oil. Therefore, for vertical injection wells, the maximum injection rate that will not fracture the reservoir is proportional to the length of the completion interval in the formation, 29 feet in this example. However, by using parallel horizontal wells for injection, as illustrated in FIG. 1, this interval is increased to the length of one side of the pattern.

All three enhancements were applied to the 29 foot thick reservoir. The upper zone WAG ratio is 28.4, only second fluid is injected at the bottom of the formation, at a rate sufficient to yield an overall WAG ratio of 5.76, and the total injection rate was increased to 224.565 cu, ft./day, the maximum rate as limited by fracturing. FIG. 4 shows the resulting location of the mixed flow zone. It occupies most of the entire 80 acre cross section; the vertical sweep is 94.1%. This high rate flood is completed quickly. It takes only 0.58 years to inject a second fluid pore volume equal to its residual pore volume at the end of the flood. Not only is recovery high, but rapid.

Conventional WAG flood recoveries using vertical wells are higher for thicker reservoirs. FIG. 5 shows the location of the mixed flow zone if the above reservoir has a thickness of 290 feet. The maximum non-fracturing flow rate is used here, 34,886 cu. ft./day. The mixed flow zone reaches 13.9 acres into the 80 acre pattern, and the vertical sweep is 9.7%. This formation thickness and recovery is representative of current applications of conventional WAG flooding. This sweep is appreciable, but still bypasses most of the vertical cross section.

Figure 6:
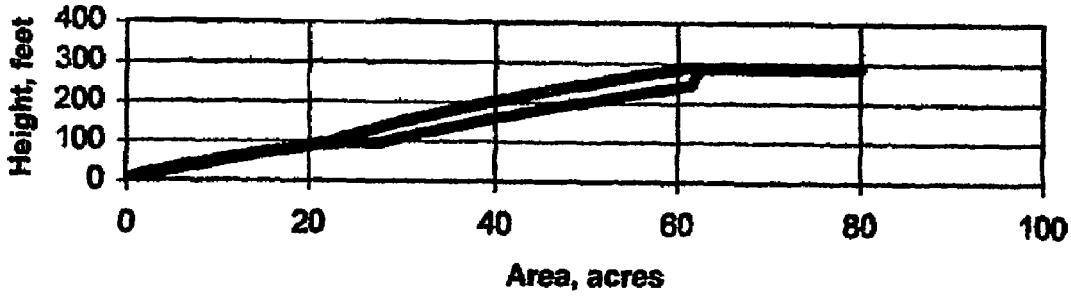
FIG. 6 shows the quasi-steady state location of a second fluid finger that forms when only water is injected in the top 99%, and only second fluid into the bottom 1% of the formation. The reservoir description is the same as the one used to prepare FIG. 5.
Figure 7:
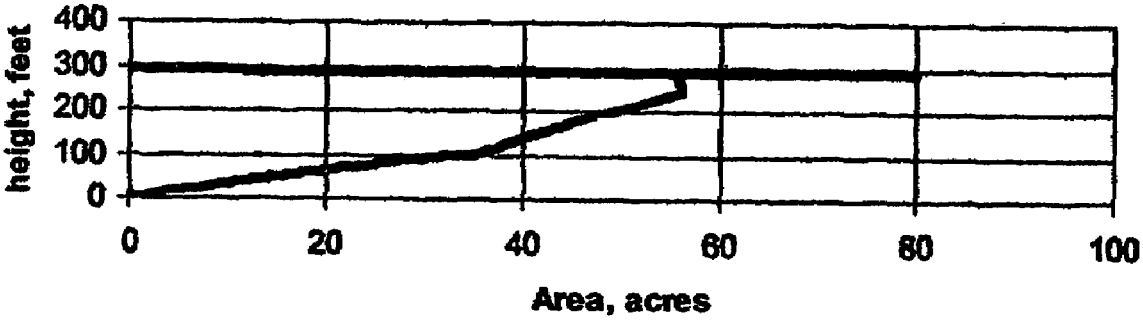
FIG. 7 shows the location of the mixed flow zone when only second fluid is injected at the bottom of the formation, and the second fluid mobility in the upper part of the pattern is kept at a low level by alternately injecting a small amount of second fluid along with a large amount of water. A good balance of the second fluid injection rate and that fluid's ultimate total flow through the upper part of the reservoir, which is determined by the second fluid mobility in that upper part, is achieved in this example. The reservoir description is the same as the one used to prepare FIG. 5.

Insight into why the controlled mixed zone mobility is so effective is obtained by considering the injection of water only in the upper 99% of the 290 foot thick reservoir described in Table I, resulting in a second fluid mobility of zero in the ensuing zone. Only the second fluid is injected into the bottom 1% of the reservoir. The injection rates of both fluids are the same as for the simulation corresponding to FIG. 5, so the WAG ratio is also the same. The location of the resulting second fluid finger is shown in FIG. 6. Gravity causes this finger to slope upward until it reaches the top of the pattern, and all of the injected second fluid stays in it, because its upward flow is blocked by the zero mobility in the zones above it. There results a sizable penetration of 61.5 acres of the 80 acre pattern before segregation is complete. The blanketing layer of rapidly flowing water and the pressure gradients that it imposes on the underlying second fluid causes the second fluid to "finger" far into the reservoir. In spite of this excellent penetration, second fluid sweep of the pattern is low, because the zone above the second fluid finger is only water flooded. However, if the second fluid and water are alternately injected into the upper 99% of the reservoir, instead of only water, then the resulting finite second fluid mobility in the mixed flow zone will allow a controlled amount of the second fluid in the finger to flow upward through the mixed flow zone above the finger. The amount of such flow is controlled by using a high WAG ratio in the upper injection zone, thus keeping the second fluid mobility small in the mixed flow zone. The goal is to select the upper zone WAG ratio that results in the dissipation of the finger just as it reaches the top of the pattern, or the producing well, whichever occurs. If such is the case, then all of the injected second fluid flows vertically into the mixed flow zone, and so contributes to oil displacement, and a good penetration of the finger also results. The result of such a well balanced injection distribution, using the same flow rates, is given in FIG. 7 for this vertical well configuration. The vertical sweep in this flood is 46.4%, 4.8 fold greater than a conventional WAG flood of the same reservoir, at the same injection rates, and with the same WAG ratio. An important result of this simulation is that the finger penetration is only slightly less than that for 100% water injection into the top zone.

Figure 8:
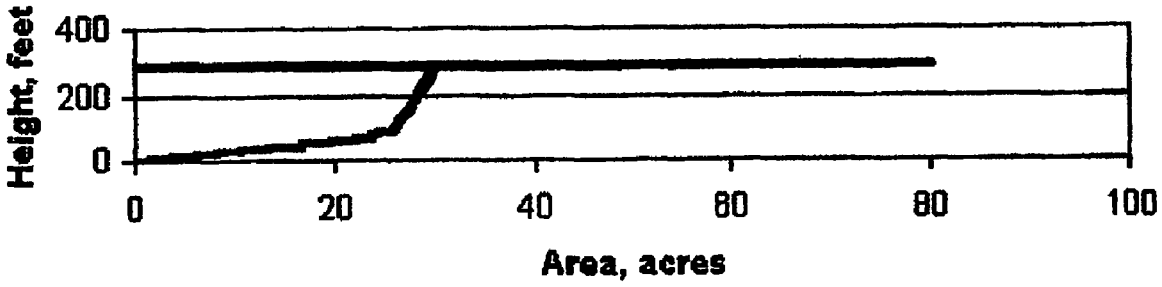
FIG. 8 shows that the mixed flow zone is truncated, thereby reducing vertical sweep, if the second fluid injection rate into the bottom of the formation is too low relative to that fluid's mobility in the upper mixed flow zone. The reservoir description is the same as the one used to prepare FIG. 5.

If the WAG ratio used in the upper zone is too low relative to the fluid injected into the finger, then the second fluid finger will be dissipated before it reaches the top of the pattern, and sweep will be impaired. FIG. 8 illustrates the resulting truncation of the finger that limits sweep to 30.2% in this vertical well system.

Figure 9:
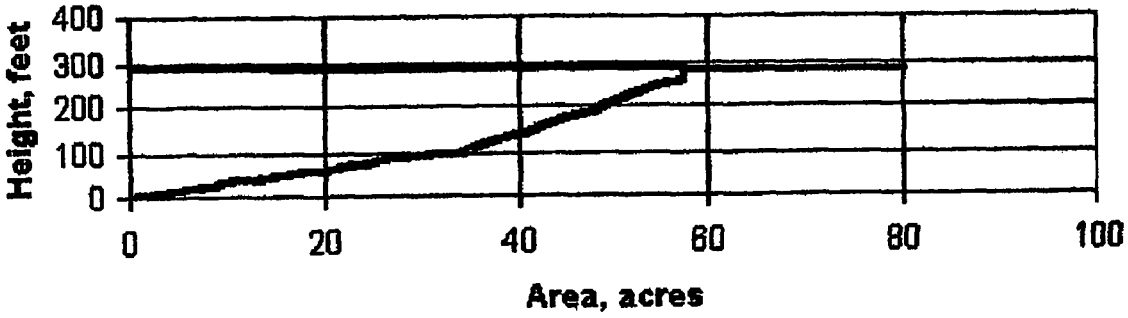
FIG. 9 shows that too high a second fluid injection rate at the bottom of the formation only slightly alters the vertical sweep shown in FIG. 7, but it does waste second fluid. The reservoir description is the same as the one used to prepare FIG. 5.

If this relationship is reversed, sweep is not greatly affected, but a fraction of the second fluid injected in the bottom interval reaches the top of the reservoir, or the producing well, without flowing through the mixed flow zone and displacing oil from it. This fraction is largely wasted. FIG. 9 illustrates such a case for a vertical well, for which sweep was 46.1%, but 23.8% of the second fluid was wasted. Sweep is almost identical to that shown in FIG. 7, which had a lower second fluid injection rate.

Figure 10:
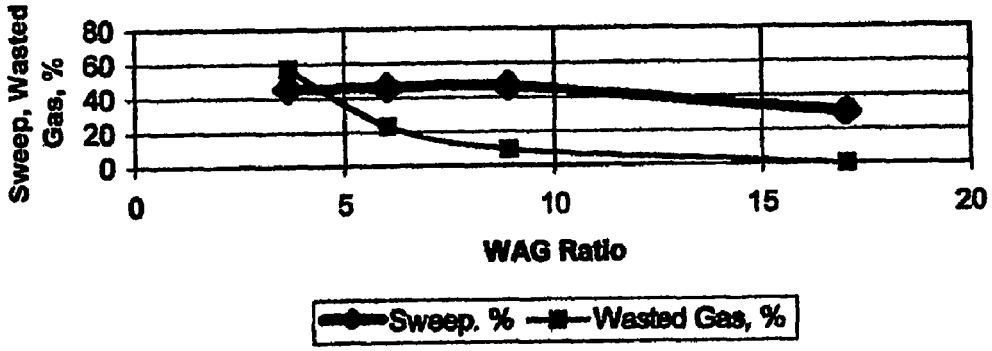
FIG. 10 shows how changing the average water-second fluid injection ratio (WAG ratio) changes both vertical sweep, and the per cent wastage of the injected second fluid for the vertical wells reservoir used to prepare FIGS. 7-9.
Figure 11:
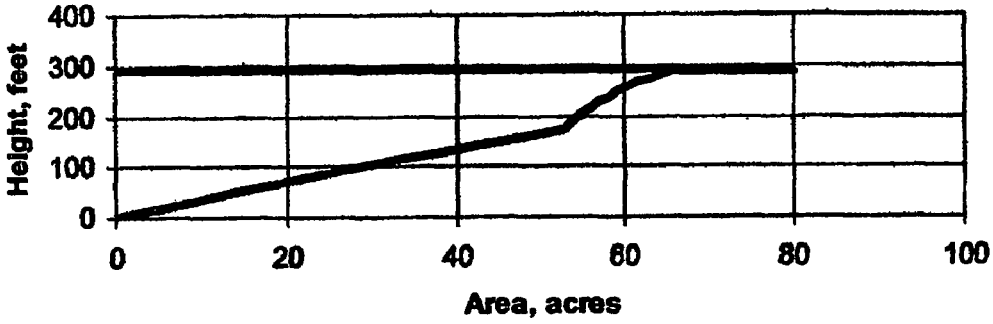
FIG. 11 shows the effect of interchanging the two different permeability layers specified for FIG. 9.
Figure 12:
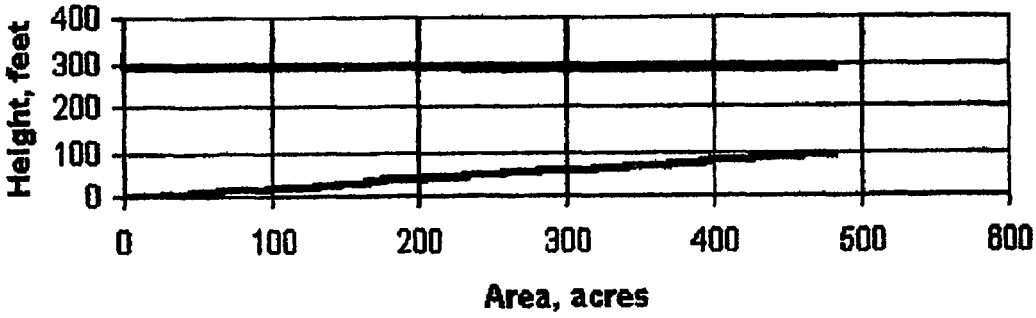
FIG. 12 illustrates a horizontal well flood design that gives both high sweep and large well spacing.
Figure 13:
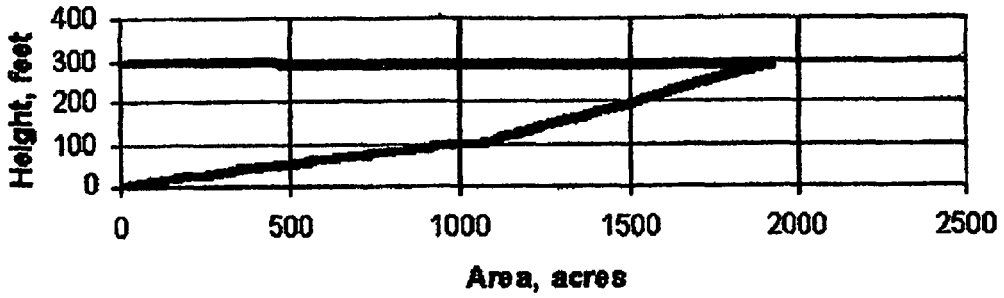
FIG. 13 illustrates the decline in fractional sweep resulting from increasing horizontal well spacing.

Both the vertical sweep and the wasted second fluid for the preceding calculations are plotted on FIG. 10, versus the average WAG ratio. Four simulations were made, all using the maximum total injection rate allowed by the fracturing pressure. The upper zone ratio to be used in the field flood is also kept the same for all simulations. When the WAG ratio is below 9.0, sweep is essentially invariant, but drops off rapidly for higher ratios because of finger dissipation. In the low ratio region, a large fraction of the injectant is being wasted, but in the higher range wastage is small. For this reservoir, using this upper zone WAG ratio, the best average WAG ratio is around 9, where sweep is high and wastage of second fluid is small.

In applying this invention, a series of plots of simulated data on figures like FIG. 10, with each plot corresponding to a different upper zone WAG ratio, is used to select the right combination of average WAG ratio and mixed zone ratio.

Using the right average WAG ratio is important, but predicting it is difficult because the formation properties are at best imprecisely known. Therefore, in practice a series of tracers, such as the perfluorocarbons suggested by Yang, et al., may be added to the second fluid injected into the lower interval. The first is added when the flood is initiated. From time to time (e.g.—of the order of months), the tracer added to the injected second fluid is changed, so that each one is added in a different time period, and analyzed for in the produced fluids. Transit time within the finger is short for second fluid that bypasses the mixed flow zone, and can be estimated. This estimate can be calibrated against the observed field performance. Observation wells are not used for these tracers, because the information desired from them is what fraction of the injected tracer reaches the producing well. If little or no tracer is found in the produced fluid and the rate of production of the second fluid is low, then too little second fluid is being injected into the finger, with the result that the finger is dissipated before its maximum penetration into the formation, as in FIG. 8. If a large fraction of the tracer is found in the produced fluids and the rate of production of the second fluid is high, then too much second fluid is being injected, and some is being wasted, as in FIG. 9. To avoid dissipation of the finger and also to avoid wasting second fluid, some tracer should be produced, but it should less than 15% of that injected, to control wastage. At the start of the process, it is best to err on the high side for the second fluid injection rate, because if too little is injected then all of this fluid and its tracer will flow out of the finger vertically, and not be produced. In this event no information is obtained in a timely fashion about how far the rate being used is from the desired rate. This use of tracers will allow the timely adjustment of injection rates and ratios. Ideally, the tracer monitoring device will automatically control the bottom zone second fluid injection rate.

This "best" rate of second fluid injection will decrease during the life of a flood. This decrease is due to the fact that the current process is essentially a bottom gas drive with gravity flow rate in each zone being invariant with location in the reservoir. As a result, the deepest penetration into the formation, and hence the thinnest tip of the mixed flow zone will soon have all of its' oil displaced, while that portion adjacent to the injection well will require the longest time. As soon as the tip is produced, the second fluid originally entering it is no longer needed. The use of a tracer will allow monitoring this decrease, and lowering the second fluid injection rate accordingly.

In a conventional single injection zone WAG flood, the nature of the reservoir heterogeneity is very important. A high permeability zone near the bottom of the reservoir is beneficial, because it will receive a disproportionate share of the second fluid injection, thereby increasing the average distance over which its' segregation has to occur. In addition the lower permeability at the top of the reservoir decreases the mobility of the second fluid in that region. As noted before, both of these effects increase recovery. Conversely, a high permeability zone near the top of the reservoir lowers recovery. In this invention, the place where the second fluid is injected is controlled, as is the fluid mobility in the mixed flow zone. For these reasons, location of the high permeability zone is not as important. This reasoning is borne out by FIG. 11, which shows the swept volume for a reservoir that has the two permeability layers interchanged from the previous calculations. Although its swept volume has a slightly different shape from that of the comparison reservoir (see FIG. 9), the two sweeps are very close, 48.5% for FIG. 11 and 46.1% for FIG. 9. The per cent wastage of the second fluid, however, is quite different, 74.6% and 23.8%, respectively. This simply means that the desired average WAG ratio is different for the two reservoirs, and the right ratio for each can be determined and used in the field, as described above.

The physical characteristics of a reservoir are of significance to this invention primarily in the manner in which they influence injection rate and well spacing. One important property that has been mentioned is the reservoir thickness. If vertical wells are used, then the practical injection rate is proportional to formation thickness. Formation penetration by the second fluid and therefore per cent sweep are proportional to the injection rate, and so sweep is proportional to formation thickness. Using vertical wells, a relatively thick reservoir (ex. 200 feet deep) will allow high injection rates and this will permit sparser well spacing. A relatively thin reservoir (ex. 20 feet deep), on the other hand, will have a low maximum injection well rate. Hence, dense well spacing will be required to achieve high recovery of oil. Such dense well spacing may not be economical. A low fracture gradient is similarly unfavorable as it limits the pressure which can be used for injection without initiating fractures and hence limits the injection rate. Fracturing is undesirable in a WAG flood and is to be avoided because it causes high rate flow channels in the reservoir which increase the rate of gravity segregation and may also adversely affect pattern sweep efficiency. Reservoir permeability is another factor influencing injection rate and well spacing. A low horizontal permeability limits the maximum injection rate. This effect is usually more than offset by the vertical permeability being less than the horizontal one, and so lowering the gravity drainage rate. It is the ratio of the horizontal to vertical permeability that is important, with a high value being desirable.

For horizontal wells the maximum injection rate is proportional to the width of the pattern (see FIG. 1). For the 80 acre pattern a horizontal well injection interval running the entire width of the pattern is 1,866.7 feet long. Dividing this number by 290.0, the thickness of the reservoir, shows that the injection rate at the same injection pressure for a horizontal well of this length is about 6.44 times greater than that for the vertical well. For a 29 foot thick formation, corresponding to FIG. 3, this ratio is 64.4. For a given thickness of formation, the ratio of the horizontal well maximum injection rate to that for vertical wells increases as the pattern area increases, because the horizontal well injection interval length is the square root of the pattern area, but the thickness remains constant. Therefore, the sweep efficiency using horizontal wells decreases much more slowly with increasing pattern size than it does for vertical wells. The net result is that horizontal wells permit the use of much larger pattern areas as well as achieving much higher sweeps. For example, using a horizontal well in a 290 foot thick formation with a 480 acre pattern and employing the maximum fracture-limited rate yielded FIG. 12. The resulting per cent sweep as 83.4%. FIG. 5 was for the same formation thickness, but with 80 acre spacing and vertical wells, also with the maximum fracture-limited injection rate. The per cent sweep shown on FIG. 5 is 9.7%. The pattern is 6-fold larger, and sweep is 8.6-fold greater. This flood is completed in a reasonable time. It takes only 15 years to inject a second fluid pore volume equal to its residual pore volume at the end of the flood. Not only is recovery high, but timely.

Figure 14:
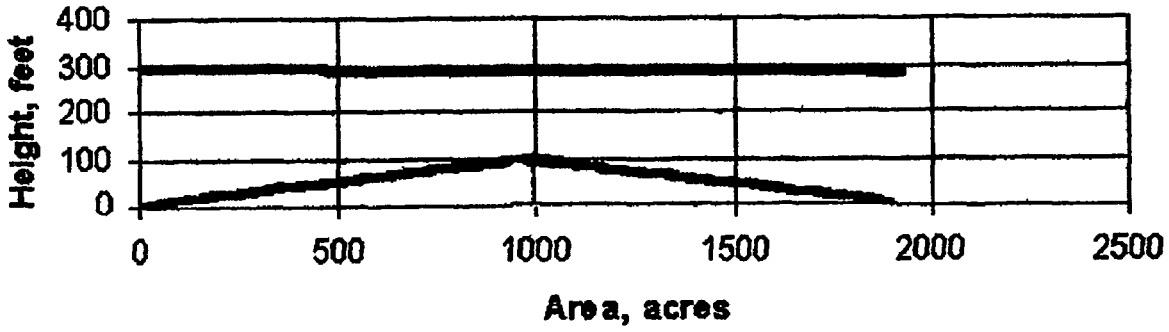
FIG. 14 illustrates the use of the well spacing of FIG. 13 along with reversal of the direction of injection to obtain essentially the recovery of FIG. 12.

With horizontal wells, even very large pattern sizes yield good sweeps. A 1,920 acre pattern gave a 60% sweep. See FIG. 13. The bottom to top nature of the second fluid flood causes the mobilized oil to flow vertically to the top of the formation and then to flow in a thin layer at the top to the producing well. Thus, the first half of a pattern could be flooded from one edge, and then well roles could be reversed and the WAG fluids injected into the opposite edge. Because oil, once mobilized, flows primarily in the thin top layer, there would be very little oil re-saturation during the second, reverse phase of the flood. The 60% recovery for the 1,920 acre pattern would be about right for this mode of operation. The unswept area from a two-way flood can be estimated by reversing FIG. 13 and superimposing this reversed figure on FIG. 13. The result is FIG. 14 that shows that at the end of the reverse flood only an isosceles triangle 94 feet high at the bottom of the formation would remain unswept, corresponding to a sweep of 83.8%. This value compares to 83.4% for the 480 acre pattern of FIG. 12, but with a 4-fold greater pattern size.

Figure 15:
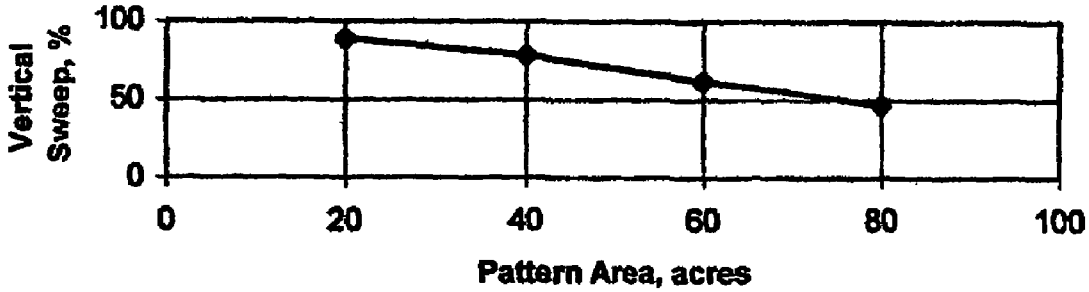
FIG 15 shows the effect of the pattern area on the vertical sweep when vertical wells are used.

For vertical wells, the penetration of the formation by the second fluid is independent of well spacing because the total injection rate is limited to the same value by formation fracturing for all spacings. As a result, close well spacing is necessary to get a high percentage sweep. FIG. 15 shows the dependence of vertical sweep on vertical well spacing for the reservoir description used. Sweep ranges from 46.4% at 80 acre well spacing, to 88.8% at 20 acres.

Figure 16:
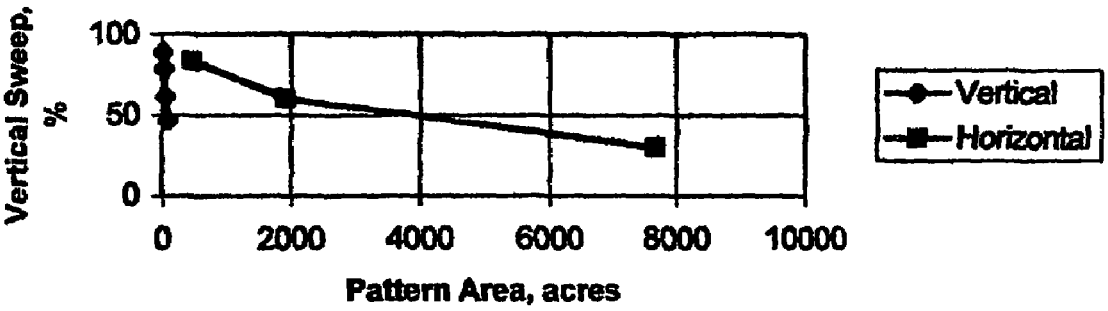
FIG. 16 shows the effect of the pattern area on the vertical sweep when horizontal wells are used.

This dependence is far more favorable for horizontal wells, as shown on FIG. 16, because, as already noted, the maximum non-fracturing injection rate is proportional to the square root of the pattern area. Sweep is 83.4% for a pattern area of 480 acres, and decreases to 30.0% for 7,680 acres. The vertical well curve from FIG. 15 is also shown on FIG. 16 to facilitate comparison. This comparison greatly favors horizontal wells.

Additional calculations explored the effect of including capillary pressure in the above reservoir descriptions. Capillary pressure causes water to be drawn into the high second fluid saturation zone, both from above and below. The resultant lowering of the second fluid saturation in said zone lowers its mobility, and therefore decreases the distance it can penetrate into the reservoir before gravity segregation moves it to the top of the formation. This lowering can be partially offset by increasing the rate at which second fluid is injected. It was found that average WAG ratio decreases by factors of 3 to 6 were needed. Even with this greatly increased second fluid injection, vertical sweeps still decreased by 10% to 50%. Percentage decreases were greatest for the less efficient floods; therefore, they tended to be small for horizontal well applications, and greater for vertical well ones. An obvious conclusion is that the presence of a surface active chemical that lowers the interfactial tension between the water and the second fluid phases would benefit sweep.

This invention is applicable equally to a virgin reservoir and to a reservoir that has been previously water flooded or gas flooded or a combination thereof. Except in a virgin reservoir, wells will already have been drilled in the reservoir. For economic reasons, it may be undesirable to drill additional wells, or in the case of a virgin reservoir, it will be economically desirable to drill as few wells as necessary.

Economics may also influence the second fluid chosen for the flood and how much of it is available for the flood. Near-miscible fluids may be substituted in this invention for miscible fluids, generally without drastically reducing the amount of oil recovered. An example of a miscible fluid which could be used is methane mixed with substantial amounts of ethane, propane and/or butane. The amount of second fluid available at the site may also be limited. Any otherwise practical WAG ratio can be used, as long as the second fluid mobility above the second fluid finger is set slightly below the matching value that prevents wastage of second fluid, or loss of sweep. Hence, selection of both the average WAG ratio and the WAG ratio in the upper injection zone provides flexibility in accommodating a limited second fluid supply. Lower values have the advantages of a shorter project life, and a more limited produced volume of injected water. Higher values result in a lower rich gas volume rate requirement for each pattern, which may offset the disadvantages of a longer project life and greater produced volumes of water. Dry gas or fluid immiscible with the oil, but miscible with the fluid which is miscible with the oil, may also be substituted for oil-miscible fluid after injection is more than half completed or after a bank of the miscible fluid has been injected of sufficient thickness or size that it is not penetrated by the dry gas or immiscible fluid.

The second fluid may also be stretched by only injecting it into a fraction of the patterns, for example, one-half. If needed, water can be injected into the remaining half of the patterns, since a prior water flood does not affect ultimate WAG flood recovery. This may be the preferred approach to maintain well productivity, or to restrict flow of the injected second fluid to one pattern element, as is necessary to force the second fluid finger to flow along the bottom of the reservoir. The remaining fraction of the patterns may be injected with the second fluid after the first fraction is completely flooded, which will probably be a number of years later. If the field-wide rate of injection of the second fluid is limited, then the sequential flooding of different segments at a higher rate results in greater vertical conformance than does flooding all patterns simultaneously at a lower injection rate. However, it increases the total production of water, in proportion to the number of fractions into which the field is divided. The early rate of oil production is not affected by this staged flooding.

The various second fluids and tracers that may be used in this process, as well as the mechanics of injection (i.e., pumps, meters, packers, check valves, etc.), will be known to those skilled in the art. Suitable miscible fluids often include intermediate molecular weight hydrocarbons such as ethane, propane and butane. Also, mobility control additives, such as polymers, may be present in the water. Surfactants may also be used to lower the effect of capillary pressure on the vertical sweep.

The principle of the invention and the best mode contemplated for applying that principle have been described. It is to be understood that the foregoing is illustrative only and that other means and techniques can be employed without departing from the true scope of the invention defined in the following claims.

I claim:

1. A method for recovering oil from a pattern element of a subterranean formation, the formation having an upper boundary and a lower boundary, the pattern element having a lower completion interval for fluid injection and a higher vertically displaced completion interval for fluid injection and a completion interval for fluid production, comprising:

injecting a gas into the lower completion interval at a first selected gas injection rate for a selection time;

injecting water into the higher completion interval at a first selected water injection rate for a selected time;

decreasing water injection rate into the higher completion interval for fluid injection for a selected time, while maintaining a selected gas injection rate into the lower completion interval for fluid injection, so as to increase rate of gas flow upward in the formation and form a mixed flow zone in the formation between the lower completion interval and the upper boundary of the formation, then continuing water injection into the higher completion interval for fluid injection; and recovering oil from the completion interval for fluid production.

2. The method of claim 1 wherein the lower completion interval is in proximity to the lower boundary of the formation.

3. The method of claim 1 wherein the higher completion interval is in proximity to the upper boundary of the formation.

4. The method of claim 1 further comprising the step of injecting water at a selected WAG ratio into the lower completion interval for a selected time.

5. The method of claim 1 further comprising the step of injecting gas at a selected WAG ratio into the higher completion interval.

6. The method of claim 5 wherein the WAG ratio is obtained by setting the second selected water injection rate at zero for a selected time.

7. The method of claim 1 further comprising adding a tracer to the gas or water before injection.

8. The method of claim 1 further comprising adding a surfactant to the gas or water before injection.

9. The method of claim 1 further comprising, after a selected time, forming vertically displaced completion intervals for fluid injection in place of the completion interval for production and reversing the direction of flow through the pattern element by injecting gas and water into the vertically displaced completion intervals for fluid injection and converting one of the completion intervals for injection into a completion interval for production.

10. The method of claim 1 wherein the gas is selected from gases consisting of natural gas, natural gas containing heavier hydrocarbons, nitrogen, carbon dioxide, flue gas and mixtures thereof.

11. The method of claim 10 wherein the gas is miscible with the oil.

12. The method of claim 1 wherein the lower completion interval and the upper completion interval are formed in vertically displaced horizontal well bores through the formation.

13. The method of claim 1 wherein the lower completion interval and the upper completion interval are performed by perforated intervals in a vertical wellbore.

14. A method for recovering oil from a pattern element of a subterranean formation, the formation having an upper boundary and a lower boundary, the pattern element having a lower completion interval for fluid injection and a higher vertically displaced completion interval for fluid injection and a completion interval for fluid production, comprising:

using predicted rock and fluid properties in the pattern element, conducting computer simulation of flow of reservoir fluids and injected gas and water in the pattern element, the injected gas and water being injected at selected rates for selected times, the gas being injected into the lower completion interval for fluid injection and the water being injected into the higher vertically displaced completion interval for fluid injection and fluid being produced from the completion interval for fluid production;

selecting the rate and times of gas injection and water injection based on the computer simulations to predict a WAG ratio to be injected into the upper completion interval so as to cause gas injected into the lower completion interval for fluid injection to flow to the upper boundary of the formation of the completion interval for fluid production at about the same time;

injecting gas and water at selected rates to cause the predicted WAG ratio; and removing oil from the completion interval for fluid production.

15. The method of claim 14 further comprising adding a tracer to the gas before injection, measuring the amount of tracer in a fluid sample from the formation and selecting a revised rate and time of injection of water or gas based on the amount of tracer in the fluid sample.

16. The method of claim 14 further comprising adding a surfactant to the gas or water before injection.

17. The method of claim 14 wherein the gas is selected from gases consisting of natural gas, natural gas containing heavier hydrocarbons, nitrogen, carbon dioxide, flue gas and mixtures thereof.

18. The method of claim 17 wherein the gas is miscible with the oil.

19. The method of claim 14 wherein the lower completion interval and the upper completion interval are formed in vertically displaced horizontal well bores through the formation.

20. The method of claim 14 wherein the lower completion interval and the upper completion interval are formed by perforated intervals in a vertical wellbore.

* * * * *